United States Patent [19]

Teranishi et al.

[11] Patent Number: 4,880,354

[45] Date of Patent: Nov. 14, 1989

[54] WARMING STRUCTURE OF GAS TURBINE ROTOR

[75] Inventors: Mitsuo Teranishi; Haruo Urushidani; Hajime Toriya; Shoji Ebine, all of Hitachi, Japan

[73] Assignees: Hitachi, Ltd., Tokyo; Hitachi Power Engineering Co., Ltd., Hitachi, both of Japan

[21] Appl. No.: 272,910

[22] Filed: Nov. 18, 1988

[30] Foreign Application Priority Data

Nov. 25, 1987 [JP] Japan ..... 62-295302

[51] Int. Cl.[4] ..... F01D 5/08

[52] U.S. Cl. ..... 416/95; 416/198 A

[58] Field of Search ..... 416/95, 198 A, 200 A, 416/201 R

[56] References Cited

U.S. PATENT DOCUMENTS

| | | | |
|---|---|---|---|
| 2,377,611 | 6/1945 | Caldwell | 416/95 X |
| 3,551,068 | 12/1970 | Scalzo et al. | 416/198 A X |
| 3,824,030 | 7/1974 | DeFeo | 416/95 X |
| 3,916,495 | 11/1975 | Klassen et al. | 416/198 A X |
| 4,184,797 | 1/1980 | Anderson et al. | 416/95 |
| 4,309,147 | 1/1982 | Koster et al. | 416/95 |
| 4,484,858 | 11/1984 | Kurosawa et al. | 416/95 |

FOREIGN PATENT DOCUMENTS

| | | | |
|---|---|---|---|
| 231952 | 8/1987 | European Pat. Off. | 416/95 |
| 114620 | 9/1979 | Japan | 416/95 |
| 165604 | 10/1982 | Japan | 416/95 |
| 96102 | 6/1983 | Japan | 416/95 |
| 22003 | 2/1985 | Japan | 416/95 |
| 209603 | 10/1985 | Japan | 416/95 |
| 17304 | 1/1987 | Japan | 416/95 |
| 913167 | 12/1962 | United Kingdom | 416/198 A |
| 988541 | 4/1965 | United Kingdom | 416/95 |

*Primary Examiner*—Everette A. Powell, Jr.

*Attorney, Agent, or Firm*—Antonelli, Terry & Wands

[57] ABSTRACT

A gas turbine rotor warming structure comprises a tubular member having an axially extending central through hole and a plurality of fine holes formed in a side wall thereof. The tubular member is inserted in central holes of rotor disks each having blades so as to form an annular gap between the inner surfaces of the central holes and the outer surface of the tubular member. The plurality of fine holes of the tubular member are formed so as to face the inner peripheral surface of the central holse of the rotor disks, so that gas extracted from a compressor is injected into the annular gap through the fine holes and impinges on the inner peripheral surfaces of the rotor disks, whereby inner peripheral portions of the rotor disks are warmed at the time of starting of the gas turbine. The extracted compressor gas which has warmed the inner peripheral portions of the rotor disks passes between the disks and cools the turbine blades.

9 Claims, 4 Drawing Sheets

WARMING STRUCTURE OF GAS TURBINE ROTOR

BACKGROUND OF THE INVENTION

The present invention relates to a warming structure of a gas turbine rotor, and particularly, more to a rotor warming structure which is so improved as to be suited for reducing a thermal stress generated in the inner peripheral part of a disk when a gas turbine is started.

An example of flow of air extracted from a compressor to cool a turbine blade in a gas turbine rotor of a conventional type is disclosed in Japanese Patent Laid-Open No. 22003/1985. The gas turbine rotor disclosed therein comprises a first stage disk, a second stage disk, a spacer disposed between the first and second stage disks, and front and rear side shafts sandwiching therebetween the first and second stage disks and the spacer and joined thereto. The first and second disks each have a central hole. The rotor has a construction that the air extracted from the compressor is introduced into first and second stage blades mounted on the first and second disks, respectively, through a central hole of the front side shaft, the central holes of the first and second disks and a space between the first and second disks in order to cool the blades.

In this rotor structure, the extracted compressor air does not flow to the central hole of the second stage disc because the central hole of the second stage disc and a central hole of the rear side shaft form a blind air passage.

The temperature of the blades rises when a gas turbine is started, since they are exposed to a high-temperature gas. The temperature of the outer peripheral part of a turbine disk rises in a short time due to the heat conduction from the blade. Meanwhile, the inner peripheral part of the disk is heated by the extracted compressor air having a temperature of about 350° C., in the case of the first-stage disk, so that temperture thereof rises. However, the speed of the rise of the temperature is much slower on the inner peripheral side than on the outer peripheral side. This causes a large temperature difference between the inner and outer peripheries of the disk in the course of the starting, and a high thermal stress on the tensile side is generated in the inner peripheral part of the disk by this temperature difference. Simultaneously, a centrifugal stress is generated in the disk due to rotation of the rotor, and the superposition of said thermal stress and the centrifugal stress causes a very large stress in the inner peripheral part of the disk at the time of starting. While the inner surface of the central hole of the first-stage disk has a relatively high heat transfer coefficient (about 400 Kcal/m$^2$ h°C.) due to the flow speed of the extracted compressor air flowing through the central hole thereof as described above, the central hole of the second-stage disk has a still lower heat transfer coefficient about 100 Kcal/m$^2$h°C. since the extracted compressor air does not pass therethrough, and thus the disk has a structure which is hard to heat at the time of starting and which generates consequently a still higher thermal stress than the first-stage disk.

Although a turbine rotor is so designed, in a conventional gas turbine, that a stress is held down to a level at which the turbine disk is prevented from breaking down even in the state of superposition of the thermal stress and the centrifugal stress at the time of the above-mentioned starting, the peripheral speed of the turbine is further increased as the performance of the turbine becomes high, and this has brought forth a problem that the stress generated in the disk due to the superposition of the centrifugal stress and the thermal stress becomes too high in the conventional structure of the rotor.

The problem of above-described prior art is that the stress generated in the disk, which is brought forth by the thermal stress generated at the time of starting being added to the centrifugal stress of the turbine disk, becomes too high when the peripheral speed of the gas turbine is further increased.

An example of a rotor warming structure of a combined turbine plant of a gas turbine and a steam turbine is disclosed in Japanese Patent Laid-Open No. 96102/1983, wherein a central gas passage is provided in gas turbine disks, front and rear side shafts, and a compressor gas extracted from a compressor enters the central gas passage. A major portion of the compressor gas entering the central gas passage is introduced into the gas turbine blades through a radial passage branched from the central gas passage to cool the gas turbine blades. The remaining small portion of the compressor gas entering the central gas passages passes through the central gas passage and it is sent to a steam turbine rotor to warm the stream turbine rotor.

When the gas turbine rotor construction is applied to a gas turbine not combined with a steam turbine, turbine efficiency decreases because there is a small amount of the extracted compressor gas passing through the central gas passage out of the gas turbine without cooling the gas turbine blades. Therefore, this rotor construction is not applicable to a gas turbine not combined with a steam turbine without decreasing the turbine efficiency.

SUMMARY OF THE INVENTION

An object of the present invention is to provide a gas turbine rotor warming structure which reduces thermal stresses generated in turbine disks at the time of starting of a turbine operation and which has stresses in the disks reduced to a tolerable value or below even in a high-performance gas turbine which has a high peripheral speed.

Thermal stresses are generated in the turbine rotor disks because the temperature of the turbine disks at an outer peripheral portion thereof becomes higher than at an inner peripheral portion thereof. The thermal stresses can be reduced by effectively heating the inner peripheral portions of the turbine rotor disks to rise in temperature thereof.

According to the present invention, a gas turbine rotor warming structure is so constructed that a tubular member having a large number of holes formed in an elongated side wall is set in central holes of the turbine disks, with air extracted from a compressor being introduced into the tubular member and with the extracted compressor air passing through the holes of the tubular member being blown against the inner walls of the central holes of the disks so as to facilitate heating of the inner peripheral parts of the disks at the time of starting of a gas turbine.

The heat transfer coefficient of the inner wall of the central hole of the each disk can be increased to about 2000 Kcal/m$^2$h°C. at the maximum by blowing the extracted compressor air against the inner wall of the central hole of the disk from the larger number of holes of the tubular member. Thereby, the speed of rise in temperature of the inner peripheral part of the disk at the time of starting of the gas turbine can be increased. Although the temperature of the outer peripheral part of the disk rises in a short time due to the heat transfer from a turbine blade at the time of starting of the gas turbine, the speed of the rise in the temperature on the inner peripheral side of the disk is increased by facilitating the heating of the inner wall of the central hole of the disk according to the present invention, so as to reduce the temperature difference between the inner and outer peripheries, and thereby the thermal stress at the time of starting can be reduced.

DETAILED DESCRIPTION OF THE INVENTION

Figure 1:
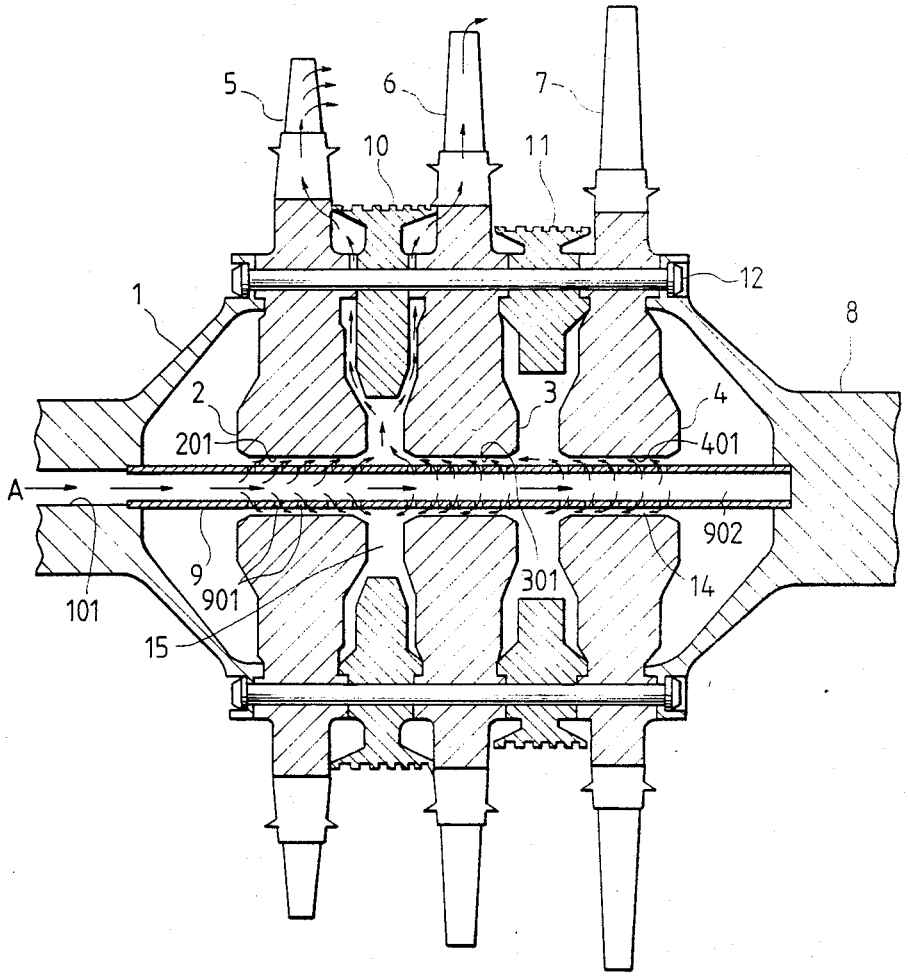
FIG. 1 is a sectional view of a gas turbine rotor incorporated with a warming structure of one embodiment of the present invention.

A gas turbine rotor showon in FIG. 1 comprises a first-stage disk 2, a spacer 10 between first and second stages, a second-stage disk 3, a third-stage disk 4, a front-side shaft 1 and a rear-side shaft 8 disposed in close contact with each other and joined together by fastening stacking bolts 12. A first-stage blade 5, a second-stage blade 6 and a third-stage blade 7 are fitted to the outer peripheries of the respective disks 2,3,4. The first-stage blade 5 and the second-stage blade 6 are cooled blades which are cooled down by air A extracted from a compressor (not shown). Each disk 2, 3, 4 has a central hole 201, 301, 401, with a tubular member 9 having a cylindrical thin-wall being common to all the disks 3, 4, 5 and extending through central holes 201, 301, 401 of the respective disks 3, 4, 5. The opposite ends of the member 9 are fixed to the inner peripheral parts of the front-side shaft 1 and the rear-side shaft 8 respectively. This tubular member 9 is provided with a large number of holes 901 opened at positions facing the respective inner walls of the central holes 201, 301, 401 of the disks 2, 3, 4. The extracted compressor air A passes through a central hole 101 formed in the front side shaft 1 and flows into the inside 902 of the tubular member 9, and thereafter it is blown against the inner wall of the central hole 201, 301, 401 of each disk 2, 3, 4 through the large number of holes 901. By the effect of this blowing, a high heat transfer coefficient of about 2000 Kcal/m$^2$h°C. at the maximum can be obtained for the inner wall of the central hole 201, 301, 401 of the disk 2, 3, 4, and thereby strong warming-up can be effected for the disk 2, 3, 4 at the time of starting of the gas turbine. After the compressor air is blown against the inner wall of the central hole 201, 301, 401 of the disk 2, 3, 4, the extracted compressor air passes through a channel 14 formed between the tubular member 9 and the inner walls of the central holes 201, 301, 401 of the disks 2, 3, 4 and flows into a space 15 between the first-stage disk 2 and the second-stage disk 3, and is introduced therefrom into the first-stage blade 5 and the second-stage blade 6. The whole quantity of the air A usd for warming the disks 2, 3, 4 is utilized for cooling the first-stage blade 5 or the second-stage blade 6. Therefore, an amount of the extracted compressor air is not increased for the purpose of warming the disks 2, 3, 4, and thus no adverse effects is produced on the performance of the gas turbine though the warming-up of the disks 2, 3, 4 is intensified. Additionally, the large number of holes 901 provided in the tubular member 9 enable the free adjustment of the heat transfer coefficient of the inner wall of the central hole of the disk, i.e. the strength of the warming-up thereof, by appropriately setting the density of disposition and the diameter thereof, thereby making it possible to conduct such a control as to execute strong warming-up for the disk having a high stress level and to execute weak warming-up for the disk having a low stress level.

Figure 2:
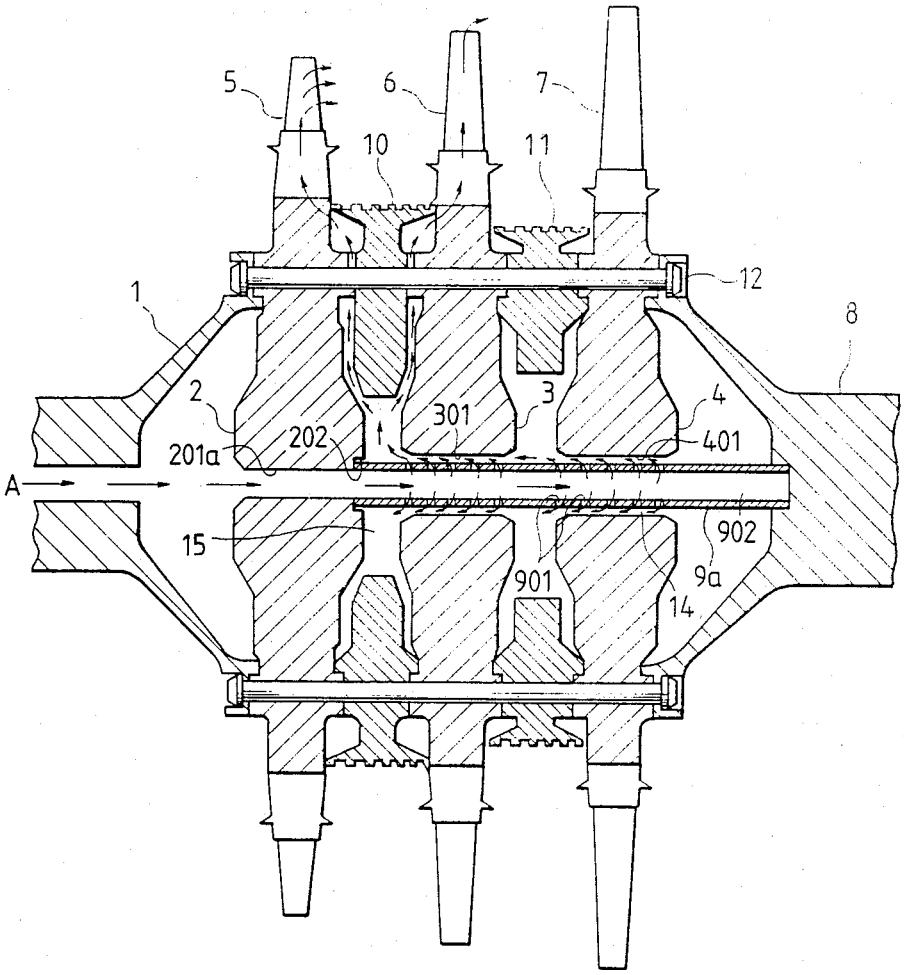
FIG. 2 is a sectional view of a gas turbine rotor incorporated with a warming structure of another embodiment of the present invention.

The embodiment of FIG. 2 of the warming differs from the embodiment of FIG. 1 in that the opposite ends of a tubular member or tube 9*a* having a cylindrical thin-wall are respectively fixed to an annular recess 202 of the first-stage disk 2 and the inner peripheral part of the rear-side shaft 8. The extracted compressor air A, which is extracted from the compressor and flows out of the holes 901 of the tubular member 9*a* warms the respective inner walls of the central holes 301, 401 of the second-stage disk 3 and the third-stage disk 4, and thereafter is introduced into the first-stage blade 5 and the second-stage blade 6 through the cahnnel 14 and the space 15 between the first-stage disk 2 and the second-stage disk 3 so as to cool down the blades 5, 6. Although warming-up by blowing the extracted compressor air is not conducted for an inner peripheral wall of a central hole 201*a* of the first-stage disk 2 in the embodiment of FIG. 2, the speed of the flow of the extracted compressor air in the central whole 201 a becomes rather high and a heat transfer coefficient of about 400 Kcal/m$^2$h°C is caused therein since the whole quantity of the air cooling the first-stage and second-stage blades 5, 6 passes therethrough. Therefore, sufficient warming-up can be executed also for the first-stage disk 2.

Figure 3:
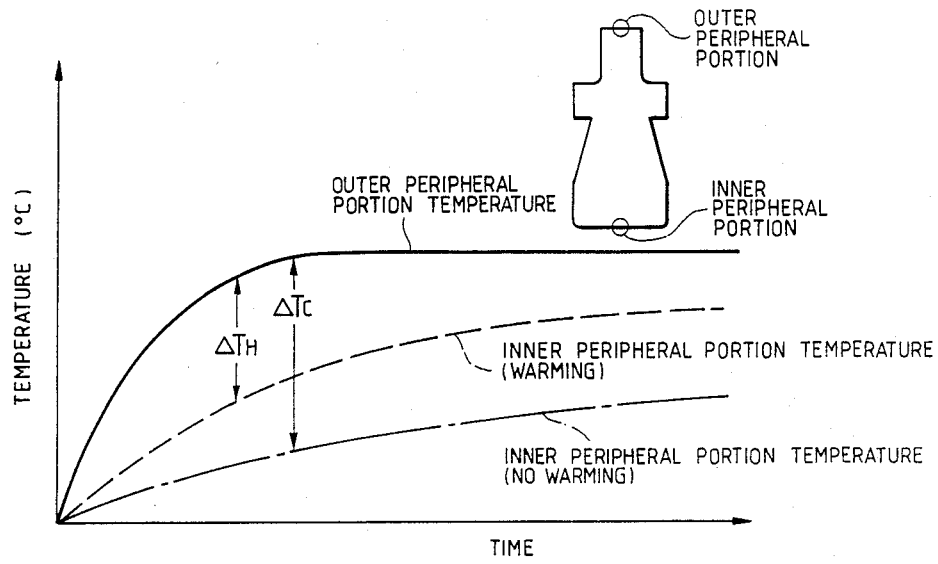
FIG. 3 is a graphical illustration showing changes in the temperature of inner and outer peripheries of a turbine rotor disk according to time.
Figure 4:
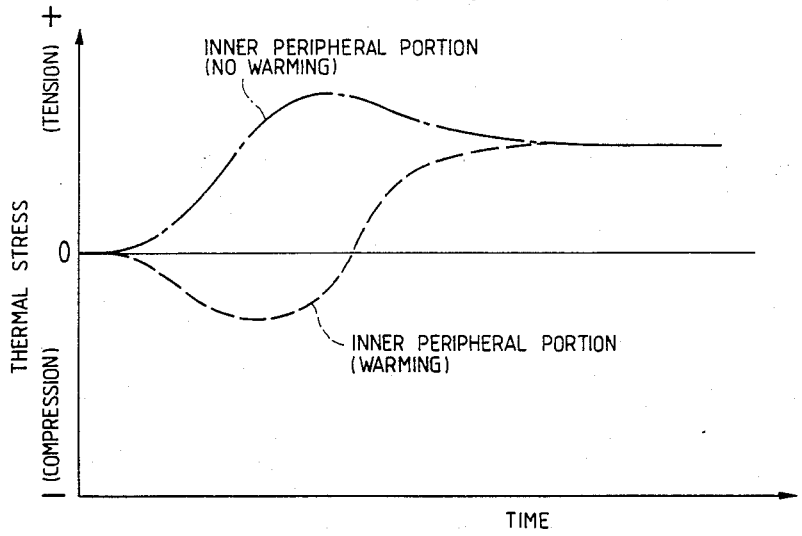
FIG. 4 is a graphical illustration showing changes in thermal stresses of the inner peripheral part of the turbine rotor disk in accordance with time.

FIGS. 3 and 4 are graphical illustrations respectively depicting the temperature of the inner and outer peripheral parts of the disk and changes in the thermal stress of the inner peripheral part thereof verses time. As the graph of shown in the graph of FIG. 3, the temperature of the outer peripheral part of the disk rises in a short time after starting, while the rise in the temperature of the inner peripheral part thereof is slower than on the outer peripheral side. It is found that the speed of the rise in the temperature of the inner peripheral part is increased considerably when warming-up is conducted according to the present invention, compared with that the rise in the temperature of said part is very slow when no warming-up is conducted (the case of the prior art). When comparison is made as to the maximum temperature difference $\Delta T$ between the outer and inner peripheral parts, $\Delta T_H$ in the case when warming up is conducted is smaller than $\Delta T_C$ in the case when no warming-up is conducted, and the former is about $\frac{2}{3}$ of the latter. As shown in FIG. 4, as for the thermal stress, a thermal stress of compression is generated in the inner peripheral part immediately after starting when warming-up is conducted according to the present invention. In contrast, a high thermal stress of tension is found to be generated immediately after starting when no warming-up is conducted.

Figure 5:
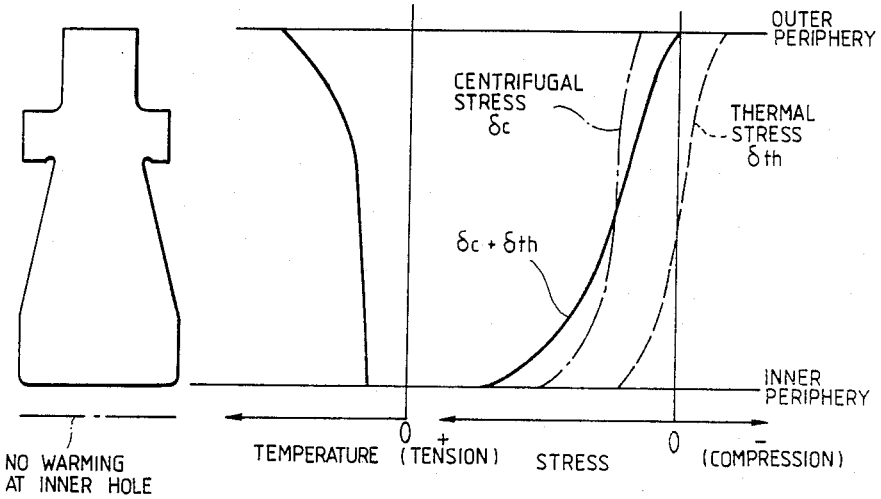
FIG. 5 is graphical illustration showing changes in temperature and thermal and centrifugal stresses on the turbine rotor disk warmed up at a central hole of the disc.
Figure 6:
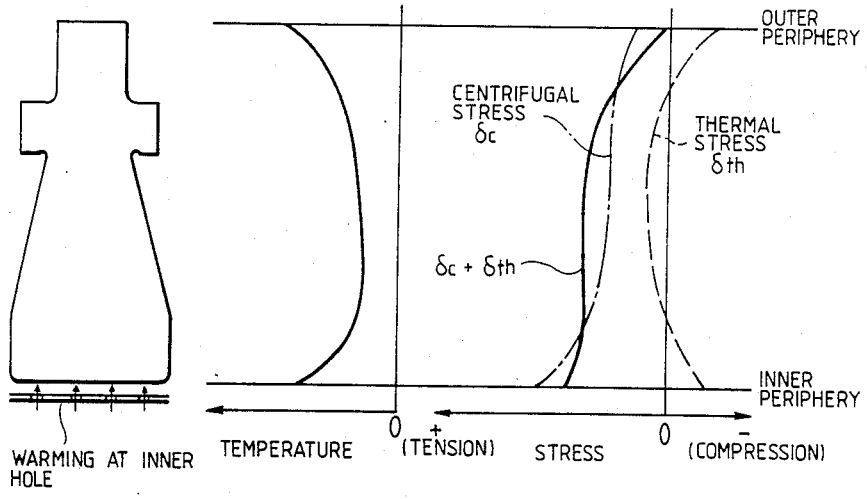
FIG. 6 is graphical illustration showing changes in temperature and thermal and centrifugal stresses on the turbine rotor disk not warmed up at a central hole of the disk.

FIGS. 5 and 6 graphically depict the cases of presence of warming-up according to the present invention as compared with the prior art cases without warming-up with regard to the temperature distribution and the stress distribution in the radial direction of the disk in the course of starting, respectively. When the temperature distribution is checked up first, as shown in FIG. 5, only the outer peripheral part of the disk is heated without warming-up and that both of the outer and inner peripheral parts are heated by the execution of warming-up. As for the stress, the centrifugal stress $\delta c$ becomes large in the inner peripheral part as shown in FIG. 5, and the thermal stress $\delta th$ acts also for the tensile side in the case of absence of warming-up. Therefore a stress $(\delta c+\delta th)$ generated by the two stresses $\delta c$, $\delta th$ being added up becomes very large in the inner peripheral part of the disk. As shown in FIG. 6, when warming-up is conducted according to the present invention, in contrast, the thermal stress $\delta th$ of compression is so generated in the inner peripheral part of the disk so as to cancel the centrifugal stress $\delta c$ (on the tensile side), since the inner peripheral part is also heated during the operation of starting. Thus, it is found that the stress $(\delta c+\delta th)$ generated by the two stresses $\delta c$, $\delta th$ being added up is not very large also in the inner peripheral part of the disk. As described above, the present invention makes it possible to reduce the thermal stress of the inner peripheral part of the disk generated at the time of starting and to hold down to a low level, the total stress generated by the centrifugal stress being added to the thermal stress.

According to the present invention, it is possible to reduce the thermal stress of the turbine disk generated at the time of starting and to hold down to a low level the total stress generated by the centrifugal stress and the thermal stress being added up in the inner peripheral part of the disk. Therefore, it becomes possible to obtain high peripheral speed of a gas turbine and to improve the performance of the gas turbine by the increased speed and also by the combustion temperature of the gas turbine being high.

Additionally, a time required for starting the gas turbine can be shortened due to the reduction of the thermal stress of the disk.

What is claimed is:

1. In a gas turbine rotor having a structure wherein air extracted from an air compressor at a stage of from intermediate to final stages thereof is introduced into a turbine blade of the rotor through a cooling passage formed inside the rotor, said rotor having a warming structure comprising:

a tubular member, having a plurality of through holes arranged in an elongated side wall thereof and inserted in central holes formed in rotor disks so as to form a space between said central holes of said rotor disks and said tubular member, said plurality of through holes being formed so as to face the inner peripheral walls of said central holes of said rotor disks;

a compressor air supply passage provided to supply the extracted compressor air to said tubular member; and an air flow passages for introducing the extracted compressor gas, having been injected to said inner peripheral walls of said rotor disks through said plurality of through holes of said tubular member, to said turbine blade.

2. A warming structure of a gas turbine according to claim 1, wherein the opposite ends of said tubular member are fitted to and supported by a front-side shaft and a rear-side shaft of the turbine rotor respectively, said compressor air supply passage including a central hole formed in said front-side shaft to supply the compressor air to said tubular member through said central hole of said front-side shaft.

3. A warming structure of a gas turbine according to claim 1, wherein one end of said tubular member is fixedly fitted in the hole formed in the disk of said rotor at a first stage and the other end of said tubular member is closed and supported by a rear-side shaft, whereby the inner peripheral wall portions of said turbine disks are warmed by the extracted compressor air passing through the inner peripheral wall portion of said first-stage disk and the extracted compressor air injected through said plurality of through holes of said tubular member.

4. In a gas turbine rotor having a plurality of rotor disks each having an inner hole, spacers each disposed between said disks, turbine blades mounted on outer peripheral portions of said disks, respectively, and front-side and rear-side shafts sandwiching therebetween and securing and disks and said spacers to form an integrated gas turbine rotor, said gas turbine rotor having a warming structure comprising a tubular member, having an elongated central through hole and a plurality of air through holes formed in an elongated side wall, and inserted in the central holes of said rotor disks so as to form an annular air space between the inner holes of said rotor disks and an outer surface of said tubular member, said plurality of through holes of said tubular member being formed to face the inner peripheral walls of said rotor disks;

an air flow passage including said annular air passage and a radial air passage between said turbine blades for introducing all the air from said plurality of through holes of said tubular member into said turbine blades; and a compressor air supply passage provided for supplying the extracted compressor air into said tubular member, whereby the extracted compressor air is jetted on the inner peripheral walls of said rotor disks through said elongated central through hole and said plurality of through holes of said tubular member to thereby warm the inner peripheral portions of said rotor disks at the time of starting of the gas turbine.

5. A warming structure of a gas turbine rotor according to claim 4, wherein said tubular member is supported by said front-side shaft and said rear-side shaft at ends thereof so that said tubular member is disposed coaxially of said central holes of said disks and said front-side shaft has a central hole to communicate with said elongated through hole of said tubular member.

6. A warming structure of a gas turbine rotor according to claim 4, wherein said plurality of air through holes of said tubular member are formed so that a warming effect is stronger at one of said rotor disks which has a higher stress level.

7. In a gas turbine rotor having a plurality of rotor disks arranged axially from first stage to final stage disks each having an inner central hole, spacers respectively disposed between said rotor disks, turbine blades mounted on an outer peripheral portion of each of said rotor disks, and front-side and rear-side shafts sandwiching therebetween and securing said rotor disks and said spacers to form an integrated gas turbine rotor, said gas turbine rotor having a warming structure comprising:

a hollow tubular member inserted in said inner central holes of said rotor disks;

air supply means for supplying extracted compressor air into said tubular member;

air blowing means for blowing extracted compressor air against inner peripheral surfaces of said inner central holes of said rotor disks to warm said inner peripheral surfaces of said rotor disks, said air blowing means including a plurality of fine holes formed in a side wall of said hollow tubular member so as to face said inner peripheral surfaces of said inner central holes with a gas there between;

rotor disk air passage means provided at least in each of the second stage to final stage rotor disks of said rotor disks for allowing the blown compressor air to flow from one side face to the other side face of each of said second stage to final stage rotor disks; and air passage means for introducing compressor air passing through said rotor disk air passage means into turbine blades of at least a first stage rotor disk.

8. A warming structure of a gas turbine rotor according to claim 7, wherein said air passage means includes a space between said first stage and said second stage rotor disks and all the compressor air blown against said inner peripheral surfaces of said inner central holes passes through said space between said first and second stage rotor disks.

9. In a gas turbine rotor having a structure wherein air extracted from an air compressor at a stage of from intermediate stage to final stage thereof is introduced into turbine blades of the rotor through a cooling passage formed inside the rotor, said rotor having a warming structure comprising:

a hollow tubular member inserted in a central hole formed in said rotor so as to extend along an axis of said rotor;

a compressor air supply passage means for supplying extracted compressor air to said tubular member;

means for radially blowing the compressor air from said tubular member against an inner peripheral surface of said central hole of said rotor to warm up the inner peripheral surface of said rotor; and means for allowing the blown compressor air to flow into said turbine blades.

* * * * *